US005623770A

United States Patent [19]

Hoffmann

[11] Patent Number: 5,623,770

[45] Date of Patent: Apr. 29, 1997

[54] PROCESS AND APPARATUS FOR DRYING PAINT AND BASE MATERIAL LAYERS

[75] Inventor: Friedrich Hoffmann, Brunn am Geb., Austria

[73] Assignee: Peter Andreas Hoffman, Brunn am Geb., Austria

[21] Appl. No.: 352,673

[22] Filed: Nov. 30, 1994

[30] Foreign Application Priority Data

Dec. 1, 1993 [AT] Austria ..... 2437/93

[51] Int. Cl.[6] ..... F26B 3/34

[52] U.S. Cl. ..... 34/267; 34/68; 34/426

[58] Field of Search ..... 34/266, 267, 420, 34/426, 68

[56] References Cited

U.S. PATENT DOCUMENTS

| | | | |
|---|---|---|---|
| 3,228,113 | 1/1966 | Fannon, Jr. . | |
| 3,554,502 | 1/1971 | Rye et al. . | |
| 3,932,114 | 1/1976 | Ebert | 34/267 |
| 4,327,665 | 5/1982 | Arrasmith | 34/266 |
| 4,771,728 | 9/1988 | Bergman, Jr. . | |
| 5,263,265 | 11/1993 | Melgaard . | |
| 5,319,861 | 6/1994 | Tate | 34/420 |

FOREIGN PATENT DOCUMENTS

| | | |
|---|---|---|
| 0203377 | 12/1986 | European Pat. Off. . |
| 0348882 | 1/1990 | European Pat. Off. . |
| 0486036 | 5/1992 | European Pat. Off. . |
| 0495770 | 7/1992 | European Pat. Off. . |
| 673956 | 3/1949 | United Kingdom . |

*Primary Examiner*—John T. Kwon
*Attorney, Agent, or Firm*—Young & Thompson

[57] ABSTRACT

In order to dry and cure a coating based on a water dilutable system, heat is supplied to the coating using an infrared radiator (1). In order to accelerate evaporation of the water, an air flow aligned perpendicularly to the infrared radiation is produced between the article on which the coating is applied, and the infrared radiator (1), using a fan (2). The power of the infrared radiator (1) and/or that of blower (2) can be changed in the course of drying and curing.

6 Claims, 7 Drawing Sheets

FIG. 3
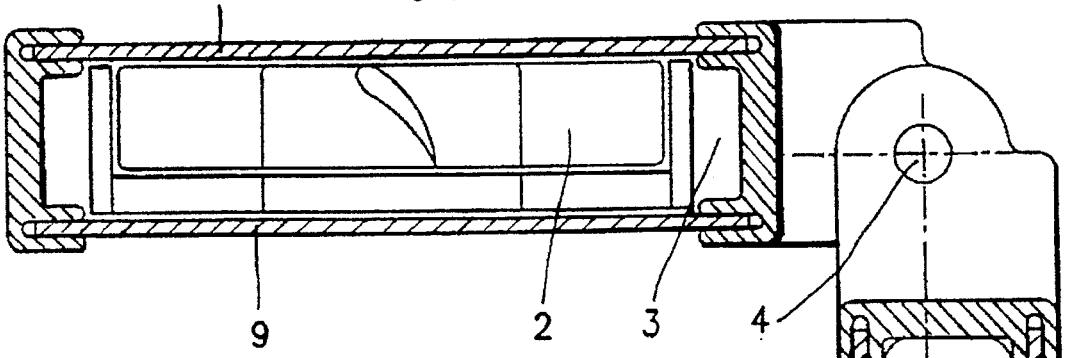
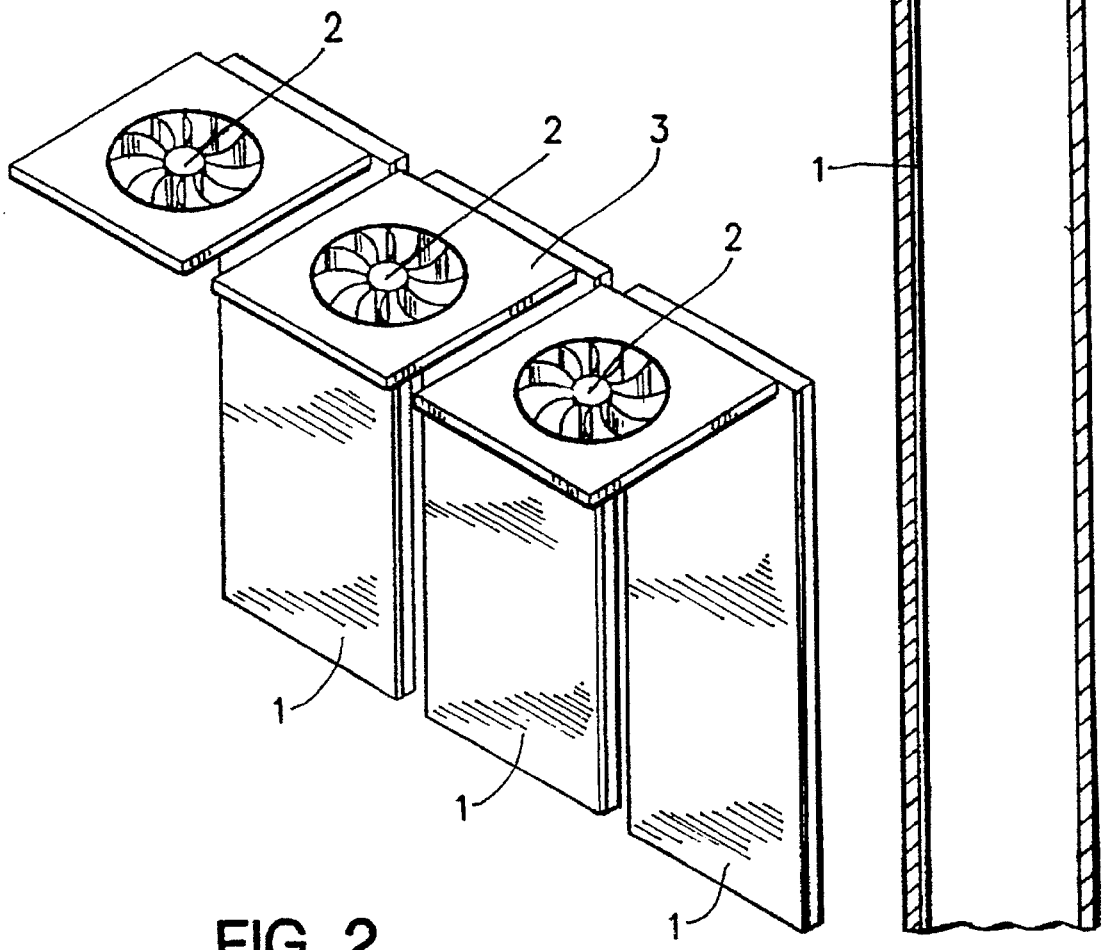
FIG. 2

TIME (min.)
35
30
25
20
15
10
5
A
A
50%
100%
POWER

TIME (min.)
35
30
25
20
15
10
5
A
A
A
50%
100%
POWER

TIME (min.)
30
25
20
15
10
5
A
A
50%
100%
POWER

PROCESS AND APPARATUS FOR DRYING PAINT AND BASE MATERIAL LAYERS

The invention relates to a process and apparatus for drying paint and base material layers.

In consideration of environmental protection regulations and in order to prevent or at least reduce the emission of hydrocarbon-based solvents, water-dilutable coatings, such as paint and base material systems, are being increasingly used.

It has been found that drying and curing of solvent-containing systems proceed fundamentally differently from the drying and curing of aqueous systems. Aqueous systems of paints and base materials require more energy for evaporation of water, the problem consisting in that the drying speed is low and depends largely on the atmospheric humidity.

While the increased energy consumption of infrared radiators, for example, those according to EP-A 495 770, can be easily raised for drying or curing of water-dilutable systems, additional measures are necessary to increase the drying speed.

A blast tunnel for drying of painted pieces is known from EP-A 203 377 in which infrared radiators are combined with blast pipes. The blast pipes of the known blast tunnel generate air flows which run parallel to the direction of the infrared radiation, therefore are aligned roughly perpendicularly to the surface of the painted workpiece. It has been found that these air flows are only suited to a limited degree for drying of water-dilutable paint and primer systems, since water vapor is only poorly removed. Increasing the power of the fan which delivers blast air to the blast pipes, in order to improve drying performance, is not easily possible since strong air flows aligned perpendicularly to the article on which a painted layer is to be dried result in undesirable, uneven paint surfaces.

The problem of the invention is to develop the process known from EP-A 203 377 such that drying and/or curing of water-dilutable coating systems, especially of paint and base material is improved and accelerated without increasing the energy demand.

According to the invention, the air flow (or air flows) are aligned roughly perpendicularly to the direction of the infrared rays, and so the removal of water vapor molecules is improved. This advantage also arises when neither the article nor the infrared radiator nor the blast pipes are moved; this makes the invention suitable for repair painting as well.

In the process according to the invention it is advantageous if the intensity of the air flow and the intensity of the heat supply via the infrared radiator(s) during drying and/or curing are changed independently of one another. In this case, for example, the process is that after application of a first layer of the coating high power (for example, the highest power) of the blower and reduced power of the infrared radiator are used. After another, for example, the second layer of the coating to be produced has been applied, the power of the blower can be increased to a higher, for example, to its highest power, and the power of the infrared radiator can be reduced to a fraction of its maximum possible power.

In this way it is possible to match the course of the process to the special properties of the coating systems (primers, filler layers, and (covering) paint layers) which are to be dried and/or cured and which are used at the time.

Furthermore, the invention makes available an apparatus with which the process of the invention can be advantageously executed.

With the invention a significant increase in the drying speed and thus a shorter drying time of aqueous coating systems such as paint and base or preliminary materials are achieved, since the energy supply via the infrared radiators (for example, those of EP-A 495 770) is combined with forced air movement oriented according to the invention.

The fans or blowers are arranged such that they produce an air flow which is aligned essentially at a right angle to the direction of the infrared radiation and which flows through a space, for example, 200 to 300 mm wide which is bounded by the surface of the infrared radiator and the article with the coating to be dried and/or cured.

The air flow causes the evaporated water to be carried away during the curing/or drying process by continuously replacing air with high humidity by air with low humidity. This takes place much more efficiently compared to EP-A 203 377 since the air flow is aligned essentially parallel to the infrared radiator and passes through the space between the article and the infrared radiator.

The air flow furthermore results in the fact that based on the boundary layer swirl which forms on the coating surface intensified release of water molecules to the air flowing past takes place.

With the process and the devices according to the invention heat is supplied to the coating to be dried by infrared radiation and at the same time the water molecules evaporating with the air flow on the surface of the coating are effectively carried off.

Therefore with the process and devices according to the invention the very narrow processing window which establishes the optimum processing conditions for aqueous products between 20° C. and 26° C. at 20% relative humidity and 26° C. to 30° C. at 75% relative humidity can be considerably widened.

For practice this means that the aqueous coating systems even at ambient temperatures can be processed far below 22° C. or even at a relative humidity of more than 75%.

For example, filler material on the one hand will be applied only in a layer thickness from 50 to 60 microns and on the other hand only after a waiting time of 15 minutes (for evaporation) will the drying process be initiated.

Both layer thickness from 40 to 60 microns as well as the waiting time of 15 minutes are unsatisfactory since on the one hand, for example in repaired auto body pans, triple the coating thickness is often necessary in order to fill in uneven sites, and on the other 15 minutes of waiting time significantly disrupt the progress of work.

It is one advantage of the invention that both the waiting time for evaporation is significantly reduced and the through-curing which can be achieved in this time is improved, and the possibility is established for producing up to 180 micron thick filler layers within a short time by several successive application processes.

With a device according to the invention which has, for example, a roughly square infrared radiator of 1.5 $m^2$ and 6 kW power consumption and eight axial fans with a total delivery volume of 1000 $m^3/h$ which are mounted on of the edges of the infrared radiators, very good results are achieved.

The device according to the invention can be equipped with a programmable microprocessor so that the interaction of the heat supply and aeration as well as their full or partial power can be continuously adapted to according to requirements and a cooling phase can be executed at the end of curing and/or drying.

With this device it is entirely possible with programming for 100% of the air flow and 30% of the rated power of the infrared radiator to reduce the waiting time from 15 minutes for evaporating a roughly 60 micron thick filler layer to 7 minutes with simultaneously improved curing. This applies analogously to paint layers as well.

Based on the time saved in the evaporation processes, when using the process and the device according to the invention it is possible in a total time of 35 minutes to produce a 180 micron thick filler layer (compare FIG. 8). If by way of comparison an attempt were made to produce a filler layer of the same thickness without using the invention, theoretically 72 minutes would be needed. After roughly 30 minutes the attempt however would have to be interrupted, especially since the filler material to be applied in the nozzle of the spray gun begins to harden and clogs it.

Advantageously the invention is pursued such that the air flow in the space between the infrared radiator and the article to which a coating to be dried and/or cured is applied is aligned from top to bottom or horizontally.

Other details and features of the invention follow from the following description in which reference is made to the drawings which show preferred embodiments of the invention.

FIGS. 2 through 6 show different embodiments of devices according to the invention in an oblique view or in a vertical section and FIGS. 7 through 9 show diagrams with additional examples for the process control.

Figure 1:
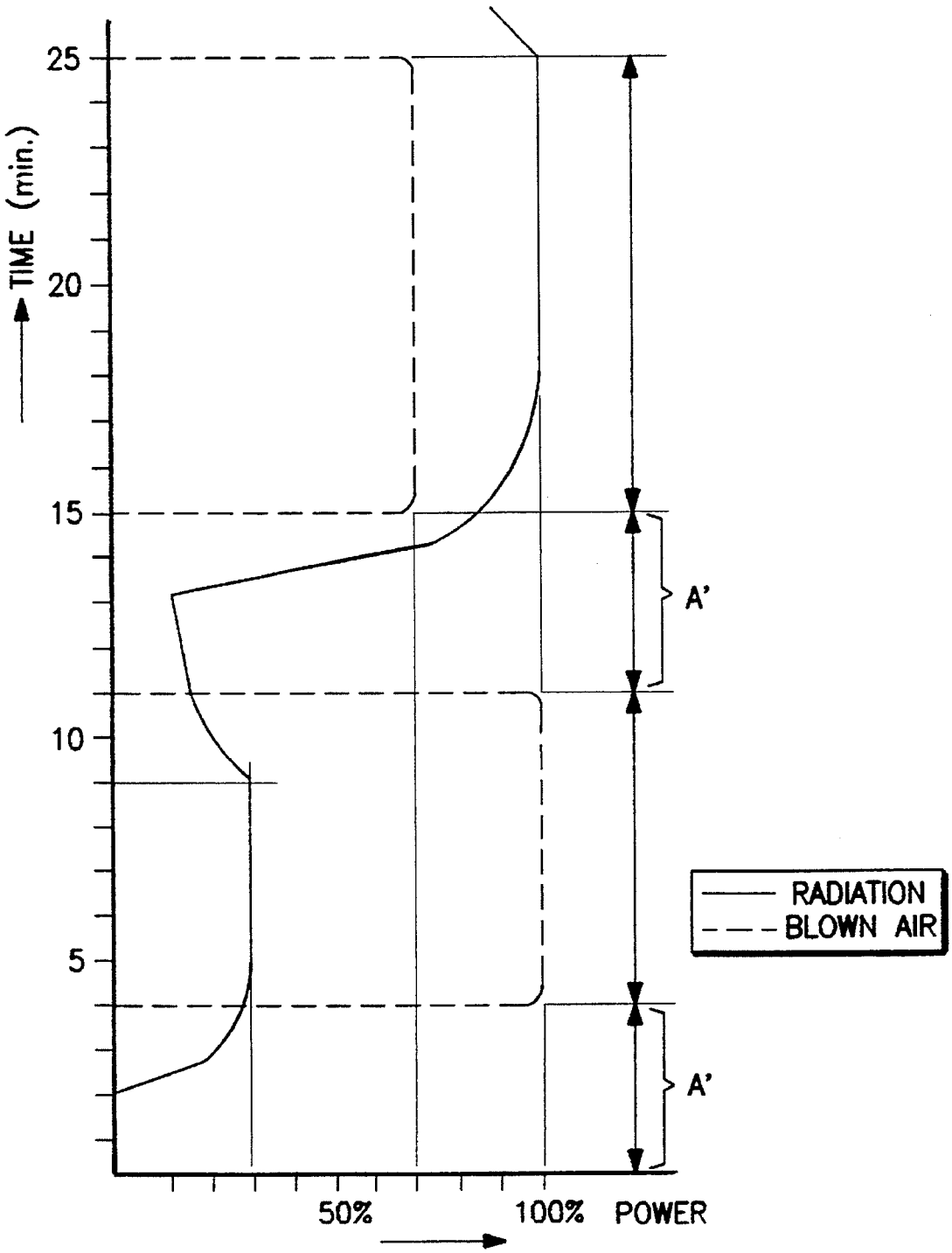
FIG. 1 shows in a diagram one example of process control in drying of filler material with a thickness of 120 microns.

It holds for all diagrams shown in the drawings that after the last segment of the process in which heat is supplied via the infrared radiator one process segment which is not reproduced in the diagrams can be eliminated, in which only the blowers (fans) are in operation in order to cool the dried or cured coating.

The diagram shown in FIG. 1 shows, using the example of a two-layer application of filler material with a total thickness of 120 microns, the course of the process in drying and curing according to the process according to the invention. On the vertical axis the time in minutes and on the horizontal axis of the diagram the delivered power in % of maximum power (100%) are plotted. The continuous line shows the delivered power of the infrared radiator and the broken line shows the behavior of the delivered power of the blower or fan which can have an embodiment according to one of FIGS. 2 through 6.

The diagram in FIG. 1 shows that first a time interval A passes in which the first layer of the filler material to be dried is applied to the article to be coated. Towards the end of application, supply of heat by the infrared radiator is begun; its delivered power is raised up to 30% of its maximum power. After the end of application (end of time interval A, for example 4 minutes) the fan is switched to maximum power and this power is maintained up to the end of the first process segment (for example, 11 minutes). The infrared radiator is turned off before the fan is disconnected alter, for example, 8 minutes so that the delivered power drops continuously to roughly 10% at time, for example, 13 minutes. At this point a second layer of filler material is applied (time interval A, for example, from 11 to 15 minutes) and at time 13 minutes the delivered power of the infrared radiator is raised up to its maximum power. After the end of time interval A the fan is started at time, for example, 15 minutes, however only with roughly 79% of its maximum power. After for example 25 minutes the drying and curing process is ended and both the infrared radiator and also the fan are turned off.

The device shown in FIGS. 2 and 3 consists preferably of several, for example, three fields 1 of infrared radiators which can have the construction known from EP-A 495 770. Infrared radiator 1 carries three axial fans 2 on its edge which is the upper one in the position of use, which generate an air flow directed downward. Axial fans 2 are accommodated in housings 3 which are separated from one another and which are attached to infrared radiator 1 which can swivel around axle 4.

Because several infrared radiators 1 and separate housing 3 are provided for fan 2, infrared radiators 1 can be installed or aligned matched to the outline of the article on which a water-based coating (for example, filler or paint) is to be dried and/or cured.

In certain cases the means according to FIG. 2 can also be arranged such that fans 2 are located on a side edge of infrared radiators 1 so that a horizontally aligned air flow is produced.

On the air inlet side and on the air exit side of housing 3 air filters 9 are inserted.

Figures 4, 5:
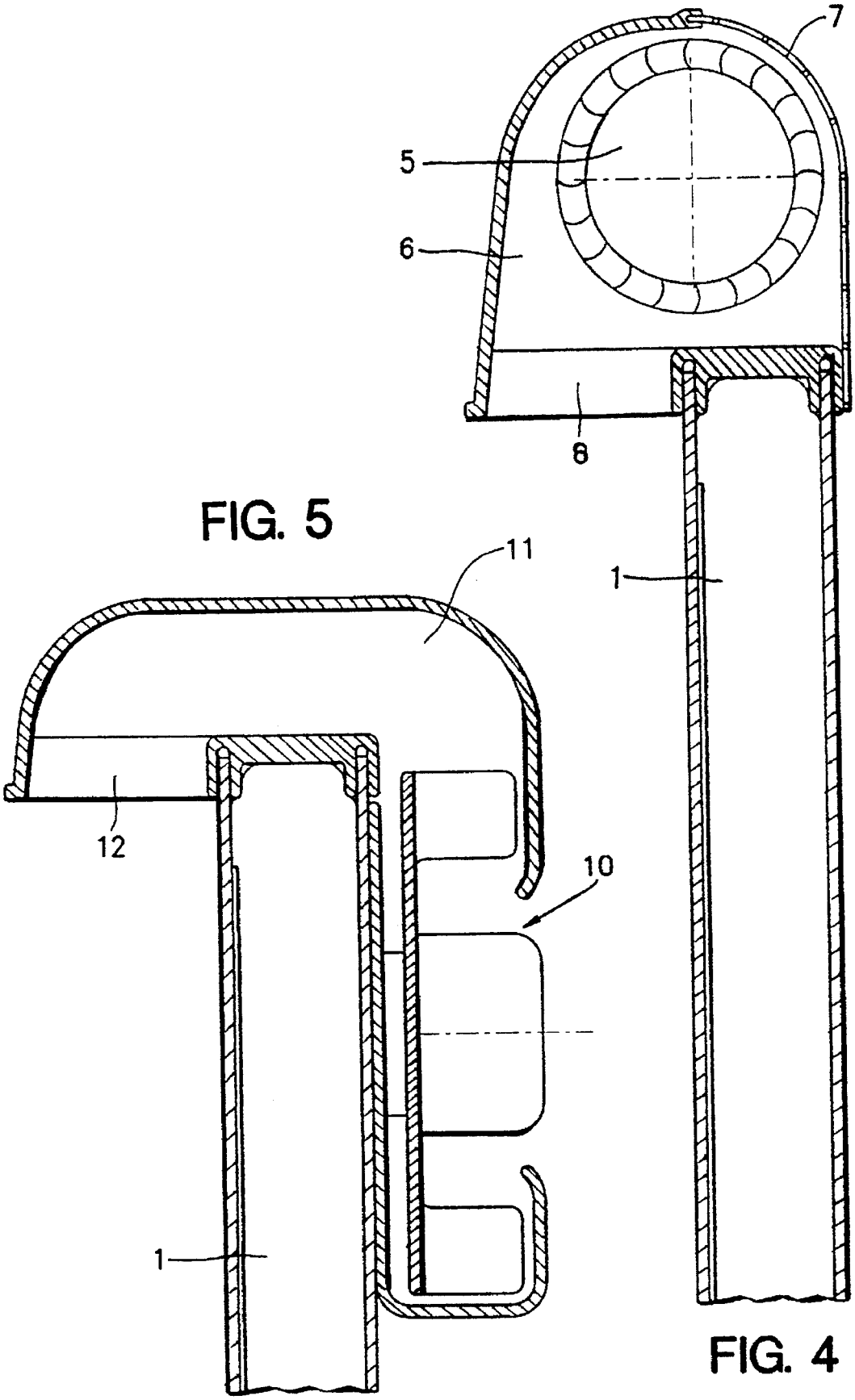
Figure 6:
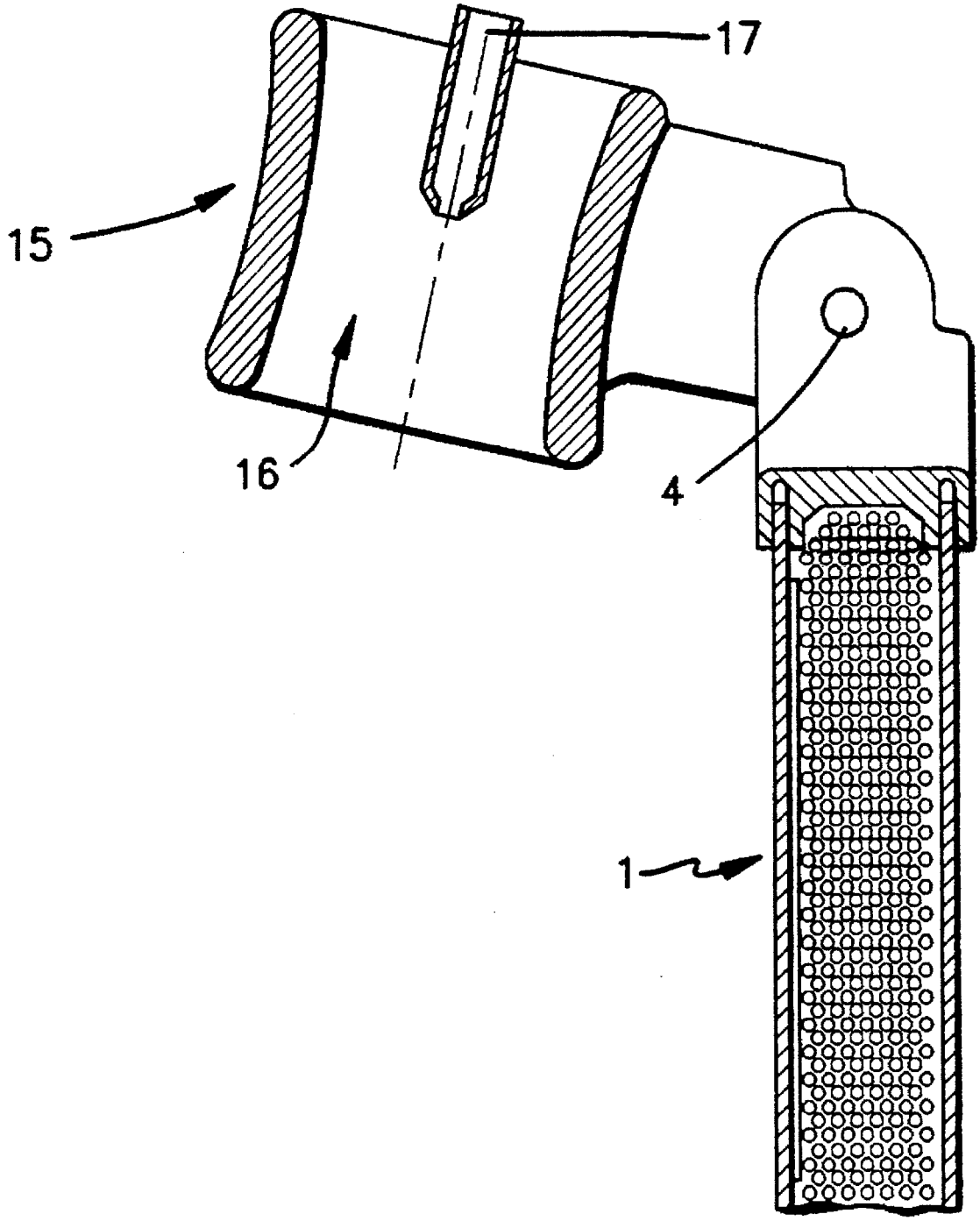

In the embodiment according to FIG. 4 on the upper end of infrared radiators 1 is a fan of the crossflow blower 5 type which is accommodated in housing 6. On the rear of housing 6 is an air intake opening covered by a screen 7. Exit opening 8 of housing 6 is pointed downward and is preferably provided with a filter.

For the embodiment shown in FIG. 5 there is radial fan 10 which routes air into channel 11 with exit opening 12 which is likewise pointed downward on the front side of infrared radiator 1 and which can be equipped with a filter.

Instead of blowers with turning fan wheels the air flow between radiator fields 1 and the article to which the coating is applied can be produced by ejector nozzles 16 operated with compressed air. One such embodiment of blower 15 is shown in FIG. 5. Here as well the mountings for blower 15 are attached on the upper edge of infrared radiators 1 to be able to swivel around axle 4. In the middle of ejector nozzle 16 compressed air line 17 ends which causes a flow of air to be produced which emerges from ejector nozzle 16 essentially parallel to the front side of infrared radiator 1.

Figure 7:
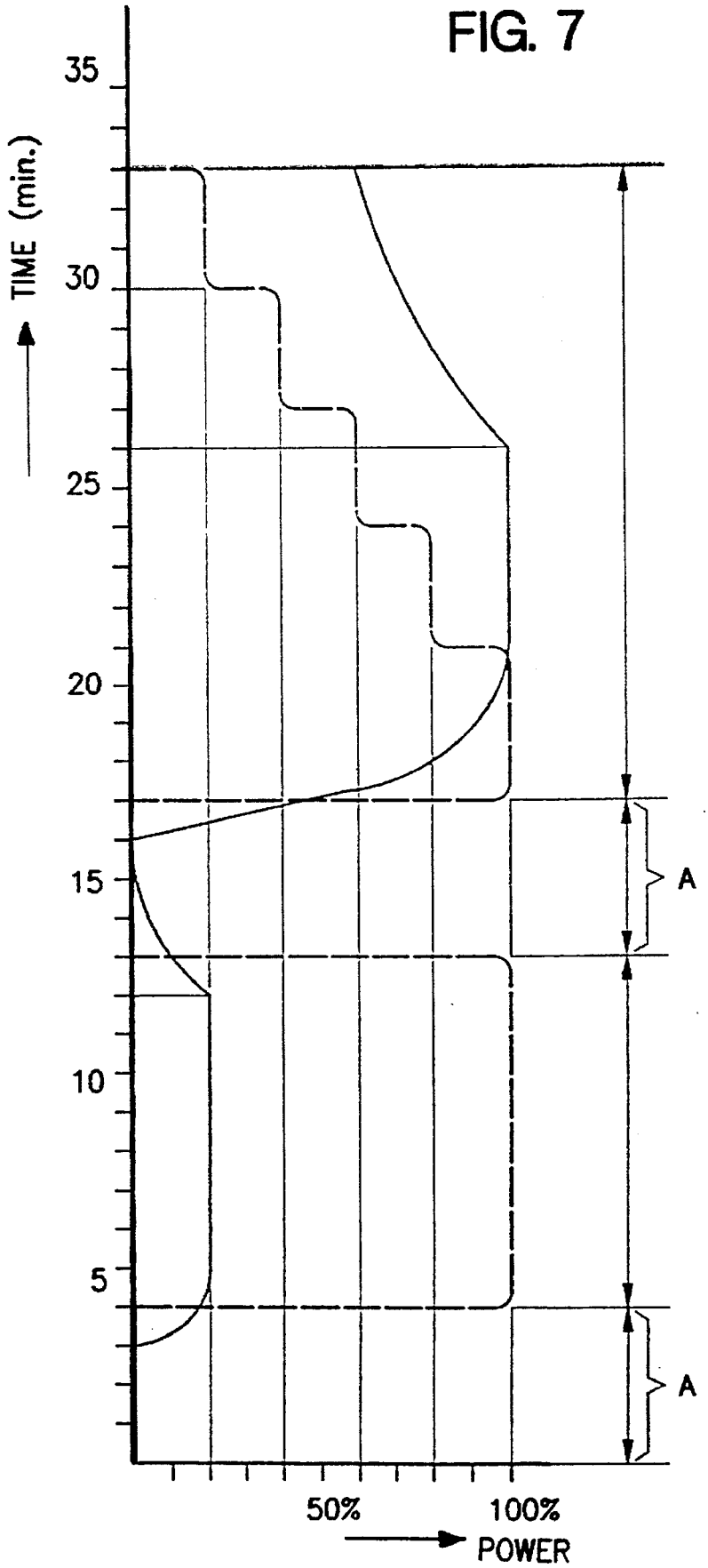
Figure 8:
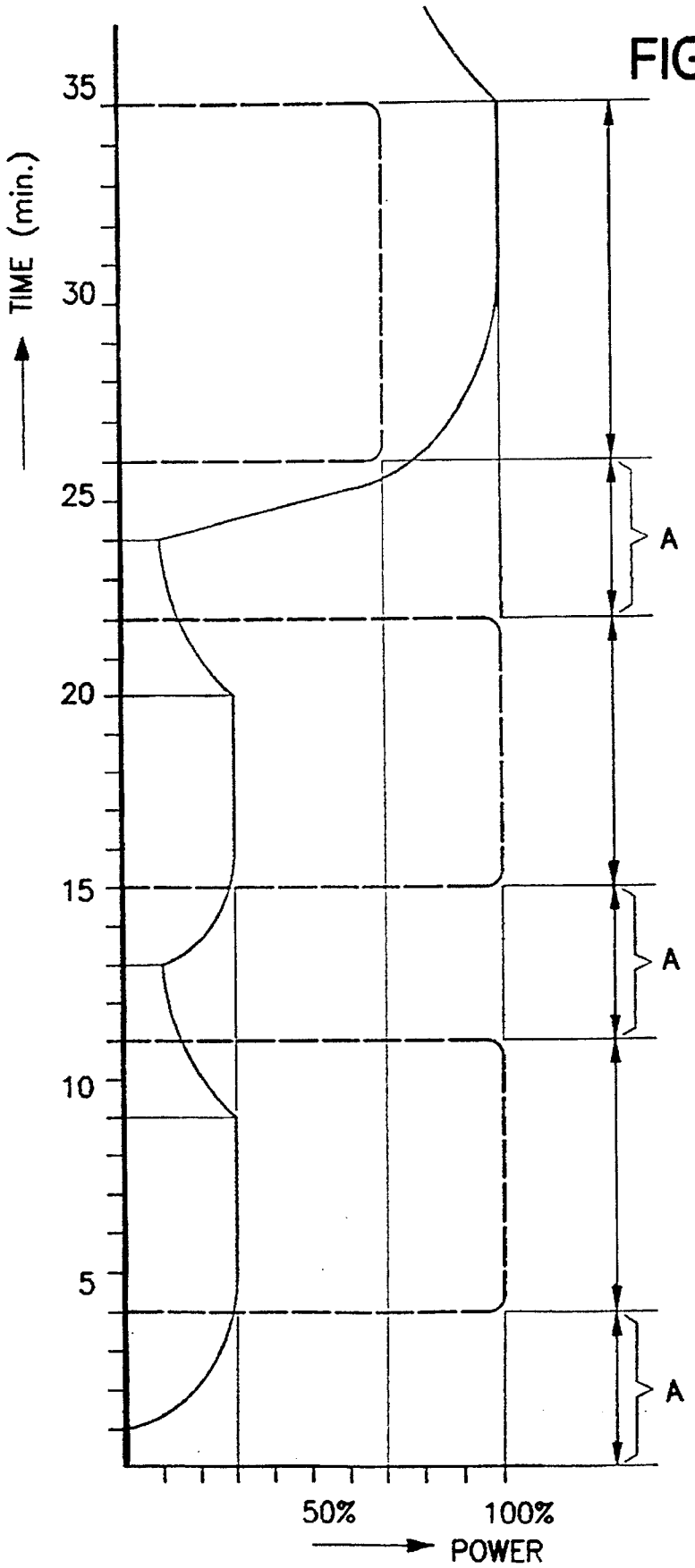
Figure 9:
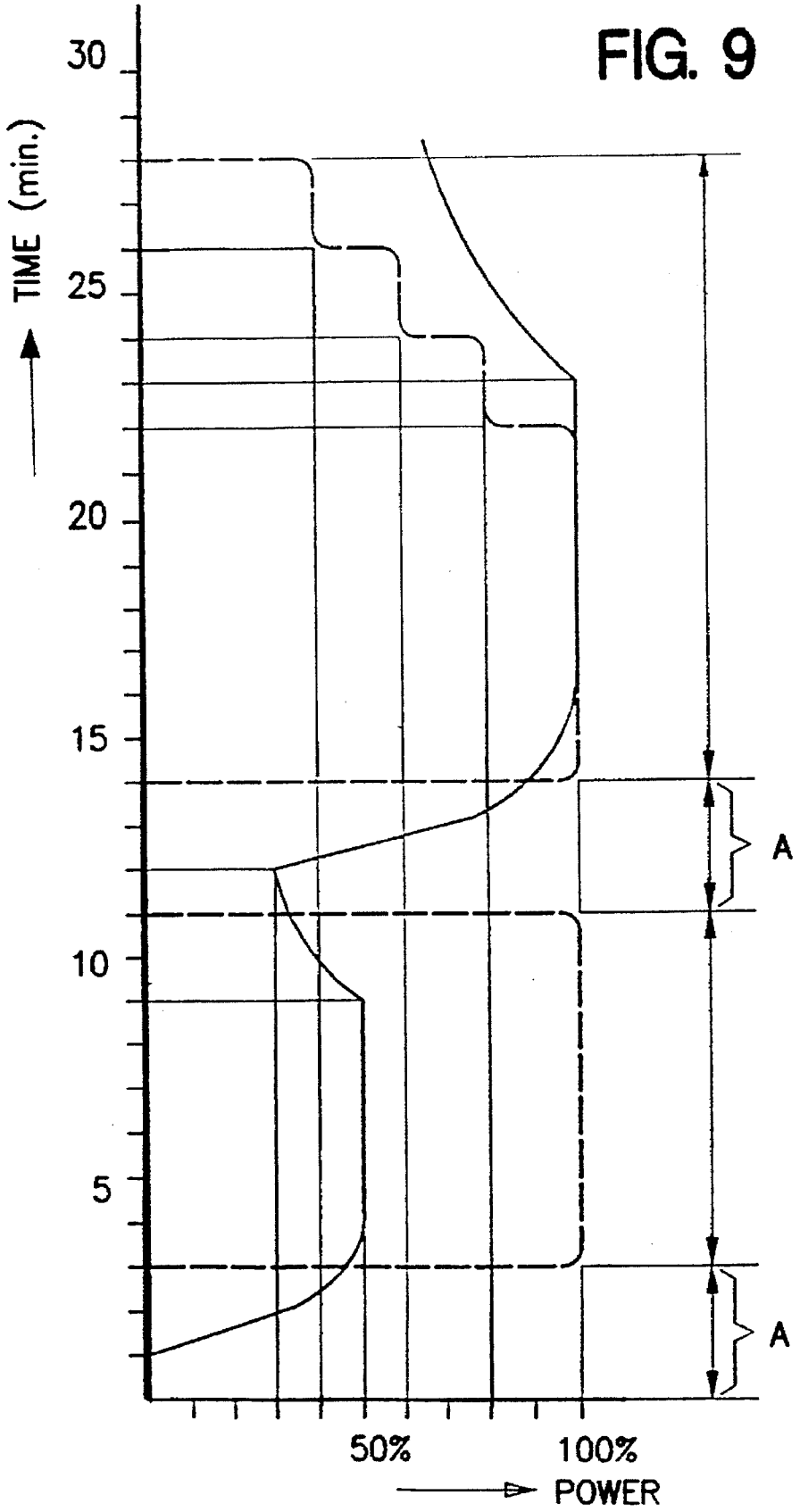

The diagrams reproduced in FIGS. 7, 8, and 9 show process evolutions which are matched to different coatings.

FIG. 7 shows a diagram with that of the process evolution for drying and curing of a finish which is applied in two layers.

FIG. 8 shows the process evolution for a layer of filler with a thickness of 180 microns. The program of FIG. 8 is a development of the program from FIG. 1.

Finally, FIG. 9 shows the process evolution in drying and curing of putty fillers according to the process according to the invention.

It is common to all process evolutions that during drying of a first applied layer of a coating from a water soluble or water dilutable system the delivered power of the infrared radiator is a fraction of its maximum power, whereas the fan operates with maximum power. After applying a second layer the power of the infrared radiator corresponds to its maximum power and the delivered power of the fan is a fraction of its maximum power.

In general terms, during the drying and curing of a first layer of a water dilutable system the air flow is moved past with higher power on the article to be coated than in the second stage after application of the second coating, whereas the delivered power of the infrared radiator in the second stage, therefore drying and curing of the second layer, is higher than in the first stage during drying and curing of the first layer.

It goes without saying that the devices according to the invention can have a control in which the process evolution most favorable at the time is stored for different coating systems and coating types (especially thickness of the coating) so that the process evolution desired or necessary at the time can be called up for example by pressing a corresponding key or inputting a corresponding characteristic or password. Thus it is also ensured that drying and curing are each executed matched optimally to the instructions of the manufacturer of the coating system.

In summary the invention can be described as follows:

In order to dry and cure a coating based on a water dilutable paint system, heat is supplied to the coating using an infrared radiator. In order to accelerate evaporation of the water, an air flow aligned perpendicularly to the infrared radiation is produced between the article on which the coating is applied, and the infrared radiator using a fan. The power of the infrared radiator and/or that of the fan are changed in the course of drying and curing.

I claim:

1. In a process for heating water-dilutable coatings on a substrate, comprising heating a coating on the substrate by infrared radiation and directing air against the substrate; the improvement comprising applying to the substrate successive first and second said coatings one atop the other, and after application of the first coating, applying infrared radiation at a first power level and driving the air at a first power level, and after the application of the second coating, driving the air at a second power level lower than the first air power level and applying infrared radiation at a second power level higher than said first infrared radiation power level.

2. Apparatus for heating water-dilutable coatings on a substrate, comprising means for heating a coating on the substrate by infrared radiation and means for directing air against the substrate, wherein there are applied to the substrate successive first and second said coatings one atop the other; the improvement comprising means, after application of the first coating, for applying infrared radiation at a first power level and means for driving the air at a first power level, and after the application of the second coating, for driving the air at a second power level lower than the first air power level and for applying infrared radiation at a second power level higher than said first infrared radiation power level.

3. Apparatus as claimed in claim 2, wherein said infrared radiation means is elongated and said air directing means is disposed at one end of said elongated infrared radiation means.

4. Apparatus as claimed in claim 3, and means mounting said air directing means for swinging movement on and relative to said infrared radiation means about an axis perpendicular to the length of said elongated infrared radiation means.

5. Apparatus as claimed in claim 2, wherein said air directing means is a fan.

6. Apparatus as claimed in claim 2, wherein said air directing means is an ejector nozzle operated with compressed air.

* * * * *

UNITED STATES PATENT AND TRADEMARK OFFICE

CERTIFICATE OF CORRECTION

PATENT NO. : 5,623,770

DATED : April 29, 1997

INVENTOR(S) : Friedrich HOFFMANN

It is certified that error appears in the above-indentified patent and that said Letters Patent is hereby corrected as shown below:

On the title page, Item [73] Assignee, change the spelling of the surname of the assignee, from "Hoffman" to --Hoffmann--.

Signed and Sealed this

Eighth Day of July, 1997

Bruce Lehman

*Attest:*

BRUCE LEHMAN

*Attesting Officer*

*Commissioner of Patents and Trademarks*